US009227126B2

(12) United States Patent
Christgau et al.

(10) Patent No.: US 9,227,126 B2
(45) Date of Patent: Jan. 5, 2016

(54) BALL REBOUND DEVICE

(75) Inventors: Joachim Christgau, Copenhagen O (DK); Nikolai Thomassen, Copenhagen N (DK)

(73) Assignee: Munin APS, Copenhagen N (DK)

( * ) Notice: Subject to any disclaimer, the term of this patent is extended or adjusted under 35 U.S.C. 154(b) by 228 days.

(21) Appl. No.: 13/498,703

(22) PCT Filed: Sep. 15, 2010

(86) PCT No.: PCT/DK2010/000126
§ 371 (c)(1),
(2), (4) Date: Mar. 28, 2012

(87) PCT Pub. No.: WO2011/038736
PCT Pub. Date: Apr. 7, 2011

(65) Prior Publication Data

US 2012/0208658 A1 Aug. 16, 2012

(30) Foreign Application Priority Data

Oct. 2, 2009 (DK) ..... 2009 01076

(51) Int. Cl.

| | |
|---|---|
| ***A63B 63/00*** | (2006.01) |
| ***A63B 69/00*** | (2006.01) |
| *A63B 71/02* | (2006.01) |
| *A63B 71/00* | (2006.01) |

(52) U.S. Cl.
CPC ..... *A63B 69/0097* (2013.01); *A63B 2063/005* (2013.01); *A63B 2071/0072* (2013.01); *A63B 2071/025* (2013.01); *A63B 2208/12* (2013.01); *A63B 2209/10* (2013.01); *A63B 2210/50* (2013.01); *A63B 2225/09* (2013.01); *A63B 2243/0025* (2013.01); *Y10T 29/49826* (2015.01); *Y10T 428/249923* (2015.04)

(58) Field of Classification Search
CPC ..... A63B 69/0097; A63B 69/0002; A63B 2210/50; A63B 2210/52; A63B 63/00; A63B 2069/0006
USPC ..... 273/395, 396; 473/431, 434, 435
See application file for complete search history.

(56) References Cited

U.S. PATENT DOCUMENTS 2,992,002 A * 7/1961 Bingham, Jr. ..... 273/395
3,427,026 A * 2/1969 Mahoney ..... 473/435

(Continued)

FOREIGN PATENT DOCUMENTS

EP 0 064 359 A2 11/1982
FR 2562431 A1 10/1985

(Continued)

OTHER PUBLICATIONS

International Search Report for Serial No. PCT/DK2010/000126 dated Oct. 11, 2010.

*Primary Examiner* — Mark Graham
(74) *Attorney, Agent, or Firm* — McCormick, Paulding & Huber LLP

(57) ABSTRACT

A ball rebound device for ball games comprising: a frame structure, a sheet being detachably attached to the front of the frame structure and adjusting means connected to the frame structure, the adjusting means being able to move part of the frame structure, whereby the tension of the sheet can increase or decrease. By stretching the sheet, it is possible to increase the rebound force of the sheet by ball impact. Similarly, the rebound force can be decreased when the sheet is slackened.

11 Claims, 4 Drawing Sheets

(56) References Cited

U.S. PATENT DOCUMENTS

| | | | | | |
|---|---|---|---|---|---|
| 3,502,330 | A | * | 3/1970 | Cyrille | 273/395 |
| 4,239,235 | A | * | 12/1980 | Torres | 473/434 |
| 4,489,941 | A | | 12/1984 | Shieh | |
| 4,553,751 | A | * | 11/1985 | Ketchum | 473/435 |
| 4,836,530 | A | | 6/1989 | Stanley, Jr. | |
| 4,948,147 | A | * | 8/1990 | Pallanca | 273/402 |
| 5,772,537 | A | | 6/1998 | Anderson et al. | |
| 5,833,234 | A | | 11/1998 | Vavala et al. | |
| 5,857,679 | A | | 1/1999 | Ringe et al. | |
| 6,209,877 | B1 | | 4/2001 | Warnick | |
| 6,299,554 | B1 | * | 10/2001 | Sinclair et al. | 473/435 |
| 8,043,172 | B2 | * | 10/2011 | Campanaro et al. | 473/435 |
| 8,246,494 | B2 | * | 8/2012 | Stephenson | 473/446 |
| 2003/0060309 | A1 | * | 3/2003 | Smith, IV | 473/431 |
| 2003/0236139 | A1 | * | 12/2003 | Jensen et al. | 473/434 |
| 2007/0090601 | A1 | * | 4/2007 | Liao | 273/396 |
| 2008/0067751 | A1 | * | 3/2008 | Hunt | 273/396 |
| 2011/0053713 | A1 | * | 3/2011 | Bulloch | 473/435 |
| 2012/0129633 | A1 | * | 5/2012 | Chen | 473/435 |

FOREIGN PATENT DOCUMENTS

| | | |
|---|---|---|
| GB | 397260 | 8/1933 |
| WO | 99/19031 A1 | 4/1999 |

* cited by examiner

BALL REBOUND DEVICE

CROSS REFERENCE TO RELATED APPLICATIONS

This application is entitled to the benefit of and incorporates by reference essential subject matter disclosed in International Patent Application No. PCT/DK2010/000126 filed on Sep. 15, 2010 and Danish Patent Application No. PA 2009 01076 filed Oct. 2, 2009.

TECHNICAL FIELD

The present invention relates to a ball rebound device for ball games, the device including a frame structure and a sheet attached to the frame structure. During training or practicing of various ball games, the ball is kicked or otherwise shot towards the sheet, and the ball is returned by a certain rebound force. Furthermore the invention relates to a method of assembling a ball rebound device.

BACKGROUND

Rebound walls are today used for training and practicing a wide range of ball games. Soccer (European football) will hereafter be used as an example of an application. A person skilled in the art would be able to see potential use for other ball games.

A ball rebound device with only one tension setting may be acceptable for practice by users at one level of skill, but wholly unacceptable for practice by others of substantially different skills. For example, a rebound device that has a loose, nonadjustable return tension level appropriately set for a beginning or child player would most likely be unacceptable to skilled players. On the other hand, a ball rebound device that has a tight nonadjustable return tension level appropriate for practice by a skilled player may prove too dangerous for use by a child or a beginner. An inexperienced ball player can easily be hurt by a fast returning ball, particularly if the user is standing too close to the ball rebound device.

An optimal rebound wall is a wall that can be used by both beginners and experienced persons and for training of various skills. There is therefore a need for a wall which can relatively easily be adjusted to the desired application.

There exists today a number of different rebound devices consisting of a metal or plastic frame with a net material lashed to the frame structure. U.S. Pat. No. 5,857,679 discloses such a rebound net using a tension adjustable elastic net material lashed to a frame structure. Adjusting the tension of the elastic netting material allows the user to alter the return speed of a ball hit against the rebound net. The frame structure can be supported with variable tilting. The net is tied with elastics or in elastically adjustable cord spirally wound around the edge of the elastic net and the frame structure. By tightening or loosing the cord, the rebound force is increased or decreased respectively.

U.S. Pat. No. 6,209,877 discloses a rebound device comprising an outer frame fitted with an inner frame. The inner frame consists of four frame parts individually bolted to the inside of the outer frame. The inner frame is provided with through-holes from the inside to the outside of the frame. Through these holes are led one string horizontally back and forth and one string vertically up and down. The two strings are weaved across each other in the same way as we know it from a stringed tennis racket. The tensions of the device increases by tightening the bolts whereby the inner frame parts are pulled closer to the inside of the outer frame and similarly is the tension of the device decreased by slackening the bolts whereby the inner frame moves away from the inside of the outer frame, thereby creating a space between the outer frame and the inner frame.

U.S. Pat. No. 4,489,941 discloses another rebound device with a net and a frame. The frame includes inner frame members. The inner frame has two adjusting rods each attached by spring elements to a side of the netting. The outer frame is attached by spring elements to the two other sides of the netting material. Adjustable screws attach each adjusting rod to outer frame.

The above-described rebound devices suffer from the disadvantages that a ball which hits the frame will achieve a significantly reduced rebound compared to a ball which hits the strings. Furthermore, the ball contact with the frame will result in an unforeseeable rebound.

The applicability of the device for training of ballgames where delivery along the ground is important, such as in soccer (European football) will be reduced. Instead of jumping back with good speed along the ground, a ball which hits the frame will jump both up and back with reduced force.

A further disadvantage of the above devices is that replacing the net is not user-friendly at all.

SUMMARY OF THE INVENTION

An object of the present invention is to wholly or partly overcome the above disadvantages and drawbacks of the prior art.

More specifically it is an object to provide a rebound device which can be used to create a wide range of real-life game situations, giving each player the opportunity to practice virtually any technical skills with a very high intensity, thereby achieving a rapid technical development. The rebound device design according to the invention also makes it possible to train passes along the ground without the ball coming into contact with the frame structure, thus giving it a perfect rebound along the ground.

It is a further object of the invention to provide a device that ensures a quick and easy adjustment of the tension of the sheet.

It is also important that the rebound device has a light construction so that the rebound device can be up scaled and still be categorized as a mobile training tool.

It is also an object of the present invention to provide a rebound device that is simple in construction, which can be sent in parts and assembled by the customer.

Still another object of the invention is to provide a rebound device that has a minimum number of different parts, to reduce the number and the cost of spare parts, and enhance the possibility to replace the sheet.

The above objects, together with numerous other objects, advantages and features, which will become evident from the below description, are accomplished by a solution in accordance with the present invention where a ball rebound device for ball games comprising: a frame structure, a sheet being detachably attached to the front of the frame structure and adjusting means connected to the frame structure, the adjusting means being able to move part of the frame structure in order to increase or decrease the tension of the sheet. By stretching the sheet, it is possible to increase the rebound force of the sheet at ball impact. Similarly the rebound force can be decreased when the sheet is slackened.

In the nearly stretched condition of the sheet, the dampening action of the ball is minimized. This is sometimes desired by the skilled soccer players. When, on the other hand, the sheet is less stretched, the dampening action is higher and the rebound force is decreased.

Such adjustable rebound force is of high value because the training device can be used for many different types of exercise ranging from exercises requiring the ball to essentially lie still after impacting the net to exercises requiring the ball to be returned at high speed.

Rebound devices having the sheet attached to the front of the frame structure make it possible to practice drill where the ball rolls or kicks along the ground because the ball will hit the sheet and be sent back without coming into contact with the frame, thereby avoiding uneven rebounds.

Having the sheet detachably attached to the front of the frame allows the user a simple way of assembling the rebound device and also enables the replacement of the sheet.

In the present specification and in the claims the term "sheet" has the general broad meaning of a bendable and non-rigid material which is thin in comparison to its length and width, including a membrane, a cloth, a woven or non-woven fabric, a web or a net, provided the mesh size of the net is smaller than the ball.

According to one embodiment of the invention the frame structure on the front comprises attaching elements for attaching the sheet to the frame structure. The attaching elements allow the user a simple way of attaching the sheet on or around the attaching elements and thereby secure an easily detachable attachment of the sheet to the frame structure.

The attaching elements may have the form of knobs, pulleys, hooks or the like.

In soccer situations often arise where the ball is delivered over distances longer than 5-10 meters. To recreate these situations in training with the rebound device according to the invention, the frame structure of the ball rebound device may preferably comprise two vertical frame elements and two horizontal frame elements assembled to a frame. Each frame element may preferably at have a length of at least 2 meters. By having a rebound device with a height of at least 2 m and a width of at least 2 m the rebound device will be usable for training of long range passes performed by soccer player at all levels.

The frame elements are preferably assembled to a frame structure by joining the frame elements at the ends or close to the ends. The joining may be a simple, user friendly connection using for example bolts or a click system. This type of joining makes it easy for the user to assemble the product himself. To make the frame as light as possible and avoid bending the frame element because of the tension from the sheet, the frame may be provided with support elements on the backside.

In a preferred embodiment the frame elements are supported by four support elements, each of them being placed between two joined frame elements and forming a triangle together with the frame elements.

A preferred ball rebound device according to the invention may on the front side of the frame structure comprise fillets and the attaching elements can be placed on these fillets. The fillets may be manufactured of any suitable, preferably light material, like for example aluminum or a carbon composite material.

According to one embodiment of the invention at least one horizontal frame element and at least one vertical frame element comprise a fillet; each of the fillets being movable on the frame elements by the adjusting means and thereby increasing or decreasing the tension of the sheet.

The adjusting means could be based on, for example, a screw principle. In a preferred embodiment according to the invention the sheet may be in the form of a net or a net-like structure. In this description and claims the term "net" covers a net in the form of two wires or strings that are interwoven so that, for example, the first two horizontal strings at the top of the frame are woven alternately over and under the vertical strings in the frame. The next two horizontal strings are then woven oppositely of the first two, under and over the vertical strings in the frame.

The above interwoven net may be delivered in a finished state and ready for attachment to the frame structure. To support the meshes during transport and avoid that the strings filter into each other, the meshes may be kept in place by hook-and-loop fasteners, like Velcro®, tape, plastic fillets with snap fastener or any other form of fixing that will keep the meshes in place and allow packing and sending the net to the user.

A net with openings for the air will give reduced damping and faster rebound as compared with a closed sheet, because the air resistance is smaller with an open net. Especially for the skilled player, the sheet or net is preferably made of an only slightly elastic material. By such arrangement, the slightly elastic or low-flexible sheet material ensures high rebound force when the sheet is stretched and also a more uniform rebound force. With the terms "slightly elastic" or "low-flexible" as used in the present description and claims is understood that the flexibility of the sheet or net should be selected as low as possible when the sheet or net still has to resist a hard ball impact in the tensioned state.

In a preferred embodiment the net or net-like structure is connected to the attaching elements at the end meshes or edge loops of the net.

According to a further aspect of the invention, the device may further be provided with an adjustable supporting structure enabling the frame structure to stand on the ground. In a preferred embodiment the supporting structure comprises means for adjusting an angle between a normal to the ground and a normal to the sheet. In this way, it is possible to adjust the tilting position of the frame structure, whereby the rebound direction can be changed to make the play more challenging for the player.

To enable a user to select the angle at which a ball is consistently returned by the ball rebound device, the frame of the device should be adjustable to provide different angles relative to the horizontal or vertical planes. For example, if the ball rebound device is set at an angle relative to the horizontal, i.e., with the top of the frame structure closer to the user than the bottom, the ball rebound device will return ground balls. If the ball rebound device is adjusted so that the angle is obtuse, i.e., with the top edge further from the user than the bottom edge of the frame, fly balls will be returned from the device.

In still a further embodiment, wheels are arranged in connection with the adjustable support structure. The wheels allow the rebound device to be moved around on the football ground. The wheels are furthermore important for adjusting the tilting position of the frame structure.

In the present description and in the claims, the term "rebound force" refers to how a ball will act when it is kicked or thrown into the sheet or net. A high re-bound force returns the ball maintaining almost all the force with which the ball was kicked.

The invention also relates to a method of assembling a ball rebound device, the method comprising the steps of:

assembling the frame structure, placing the net on the attaching elements on the frame structure and stretching the net by moving part of the frame structure.

Assembling the ball rebound device is easy and the ball rebound device may be delivered unassembled. The frame structure may be delivered in parts and assembled by the user, and the net may be delivered finish woven, with for example, hook- and loop-fastener like Velcro® for securing against laddering of the net. When the net is attached to the frame structure, the Velcro may be removed and the net adjusted to the desired tension.

The invention also relates to a sheet wherein the edge masks are held in place by fixing means, preferably hook- and loop-fasteners.

The invention relates furthermore to a sheet for use in the method of assembling a ball rebound device characterized in that the edge masks are held in place by fixing means, preferably hook- and loop-fasteners.

The frame structure may be manufactured of any sturdy material.

The ball rebound device according to the invention can be manufactured with a relatively low total weight, making it easy to handle, transport, mount and take down, which makes it applicable for a large target group, including children and professional soccer players.

A relatively low total weight may be obtained by using a low-weight material for the frame structure. Examples of low-weight materials are light metals, such as aluminum or a carbon composite.

The frame structure is preferably assembled to a parallelogram with a size larger than 150×150 cm and more preferably larger than 200×200 cm. 250 m×250 cm turned out to be a good size, not too big to be mobile and big enough to be usable for training of long range passes.

BRIEF DESCRIPTION OF THE DRAWINGS

The invention and its many advantages will be described in more detail below with reference to the accompanying schematic drawings, which for the purpose of illustration show non-limiting embodiments and which.

Figure 1:
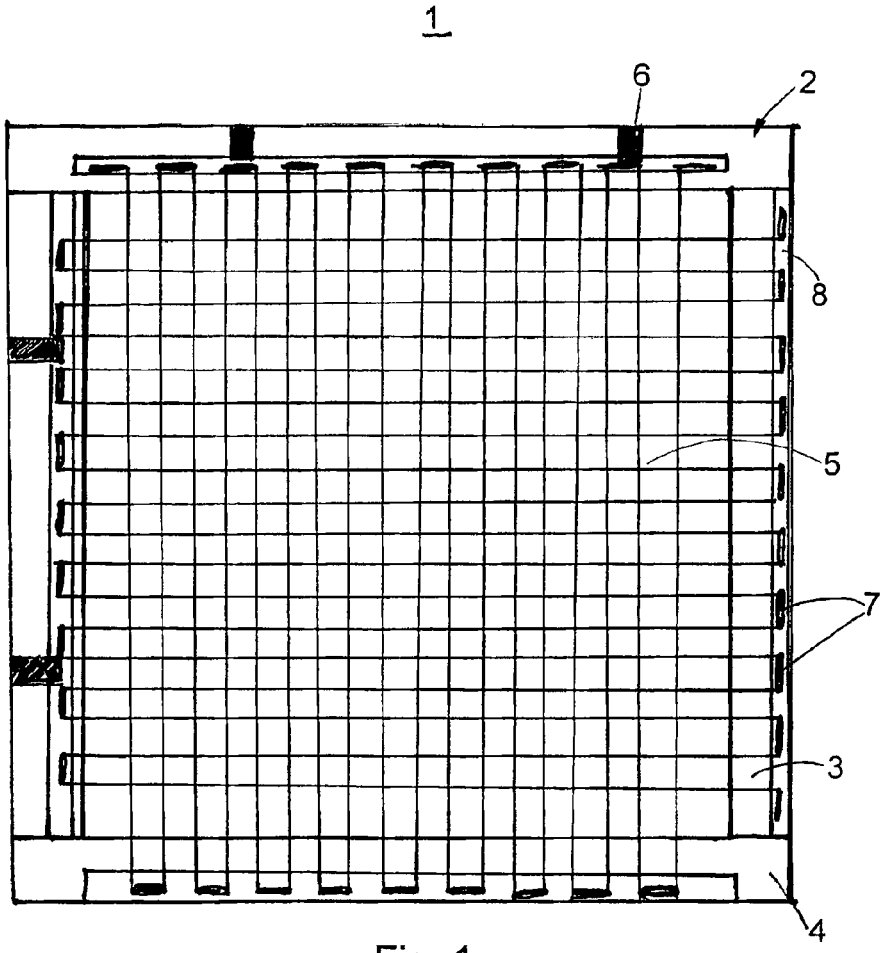
FIG. 1: illustrates an embodiment of the rebound device viewed from the front.

All the figures are highly schematic and not necessarily to scale, and they show only parts which are relevant in order to elucidate the invention, other parts being omitted or merely suggested.

DETAILED DESCRIPTION OF THE PREFERRED EMBODIMENT

The invention will be more concretely described with reference to its preferred embodiment shown in the accompanying figures. In those figures, reference numeral 1 designates the ball rebound device according to the invention. The ball rebound device has a frame structure 2 and a sheet 5 detachably attached to the front of the frame structure 2. The tension of the sheet can be increased or decreased by adjusting means 6 which are able to move part of the frame structure.

FIG. 1 discloses schematically an embodiment where the frame structure 2 is assembled and comprises four frame elements, two vertical frame elements 3 and two horizontal frame elements 4 being connected at the corners to a rectangular frame. On each of the four frame elements 3, 4 are placed fillet 8 and attaching elements 7 for attaching the sheet 5 to the frame structure 2. On one of the vertical frame elements 3 and the horizontal top frame element 4, the fillets 8 are adjustably connected to the frame elements 2 by means of adjusting means 6. The other vertical fillet and the bottom fillet are in this embodiment permanently connected to their respective frame elements.

In the embodiment disclosed in FIG. 1 the attaching elements 7 are placed on the fillets 8, the attaching elements 7 may as well be placed on frame elements without fillets.

Figure 2:
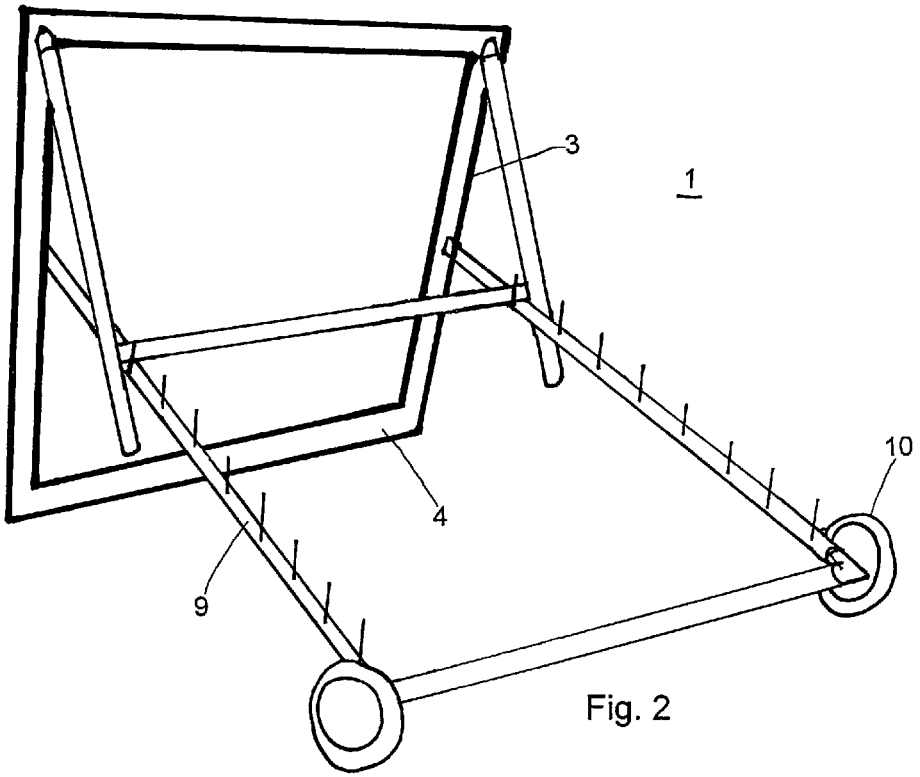
FIG. 2: illustrates a perspective view of the rebound device in FIG. 1 viewed from the back and without any sheet.

FIG. 2 discloses schematically a perspective view of the backside of the ball rebound device according to the invention without any sheet. The ball rebound device can be supported to an upright position in many ways. In FIG. 2 the ball rebound device is supported by an adjustable supporting structure 9 with means for adjusting an angle between a normal to the ground and a normal to the sheet. The supporting structure 9 comprises an H-like structure where the upper part of the two legs in the H are pivotably linked to the upper part of the frame structure 2 and two bars are mutually joined and connected to the vertical frame elements 3. The two bars are provided with a number of stop elements. A support structure of this type enables a user to adjust the tilting position of the frame structure, whereby the rebound direction can be changed. The users only have to lift the H-like support structure and place it in front of new stop elements. The support structure 9 in FIG. 2 is provided with two wheels 10 which make it possible to move the rebound device around on the football ground, thereby practicing different play situations like situations close to the football goal.

Figure 3:
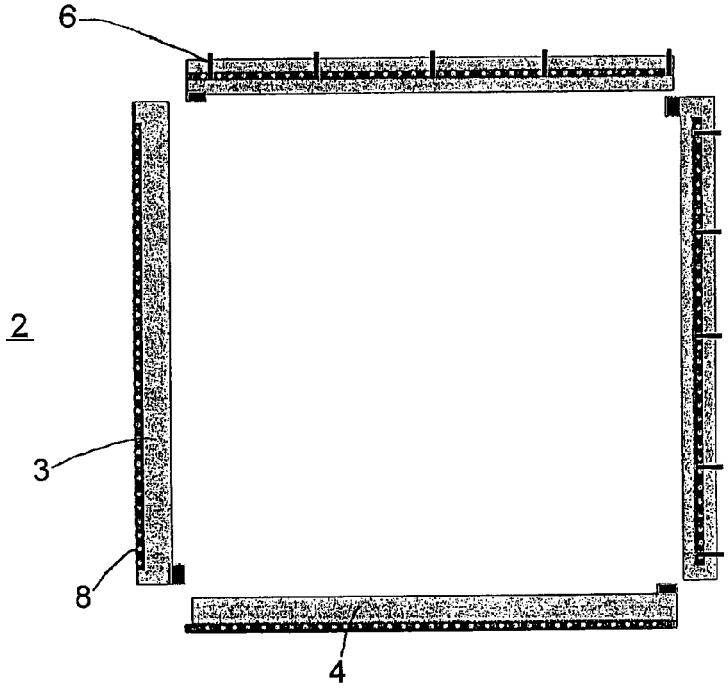
FIG. 3: illustrates a frame structure before the frame elements are assembled.
Figure 4:
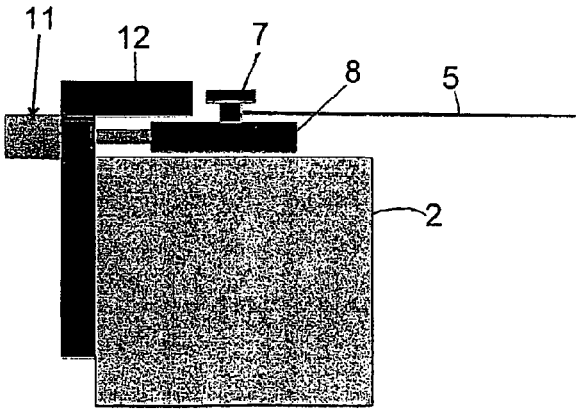
FIG. 4: illustrates an embodiment of the adjusting means and a part of the frame structure in a side view.

FIG. 3 discloses schematically two vertical and two horizontal frame elements 3, 4 before they are assembled to a rectangular frame structure 2. The bottom fillets 8 and one of the vertical fillets 8 are placed close to the edge of there respective frame elements 3, 4. The top fillets and the other vertical fillets are adjustably connected to their respective frame elements 3, 4 by adjusting means 6, which can move the fillets closer to the edge and thereby increase the tension of the sheet. In FIG. 4 an enlarged embodiment of the adjusting means 6 is disclosed.

FIG. 4 discloses a schematically enlarged side-view of an embodiment of one adjusting means 6. When tightening the screw 11 the fillet 8 with the attaching element 7 moves closer to the bracket 12 which is placed on the frame element 2. By moving the fillet 8, the attaching element 7 will move and the tension of the sheet 5 will be increased and thereby the rebound effect will increase. When loosening the screw 11 the fillet 8 with the attaching elements 7 is moving closer to the middle of the sheet 5 and thereby loosen the tension of the sheet 5 and the rebound effect will decrease.

Figure 5:
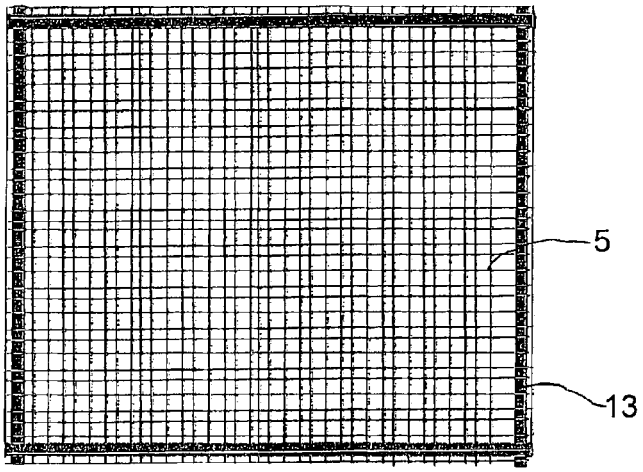
FIG. 5: illustrates a separate sheet, where the edge masks are held in place by means of hook-and-loop fasteners, like Velcro®.

FIG. 5 discloses a sheet 5 in the form of a net ready for being attached to the frame structure. The meshes are held in place by means of Velcro® 13 placed at the end meshes.

Figure 6:
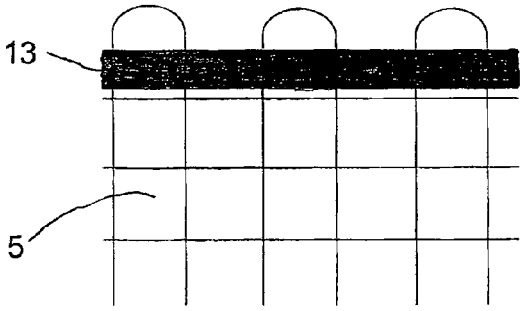
FIG. 6: illustrates section A from FIG. 5 enlarged

FIG. 6 discloses an enlarged section of a part of FIG. 5, where some of the end meshes of the net are held in place by Velcro®.

Figure 7:
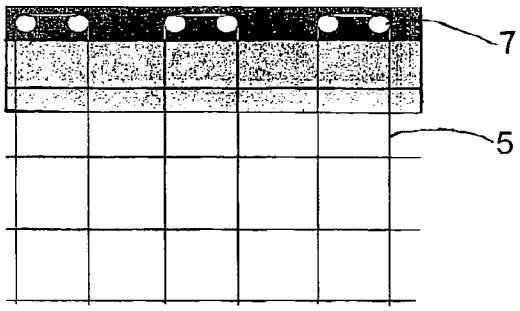
FIG. 7: illustrates an enlarged view of a sheet attached to the attaching elements.

FIG. 7 discloses the end meshes of the net 5 in FIG. 6 placed around the attaching elements 7. The attaching elements 7 are here disclosed in the form of knobs. Two knobs are placed at a distance apart corresponding to the desired mesh size and a net mesh is placed around both knobs. The attaching elements 7 could have many forms. The function of the attaching elements is to attach the sheet or net to the frame structure and secure the right mesh size.

The sheet or net may be prepared of any suitable material. Preferred materials include synthetic polymers like polyamides for example nylon.

To provide a uniform rebound of the ball, the mesh size must not exceed 7×7 cm.

Although the invention above has been described in connection with a preferred embodiment of the invention, it will be evident for a person skilled in the art that several modifications are conceivable without departing from the invention as defined by the following claims.

What is claimed is:

1. A ball rebound device for ball games comprising:

a rectangular frame structure comprising two vertical frame elements and two horizontal frame elements joined together to form the rectangular frame structure, wherein forward-facing surfaces of the two vertical frame elements and two horizontal frame elements define a front-side plane of the rectangular frame structure;

a first fillet abutting at least one of the two vertical frame elements on the forward-facing surfaces defining the front-side plane of the rectangular frame structure;

a second fillet abutting at least one of the two horizontal frame elements on the forward-facing surfaces defining the front-side plane of the rectangular frame structure;

a sheet detachably attached to the first and second fillets abutting the front-side plane of the rectangular frame structure by attaching elements; and wherein the first and second fillets adjustably abut the front-side plane of the rectangular frame structure such that the tension of the sheet is configured to be increased or decreased.

2. The ball rebound device according to claim 1 wherein the rectangular frame structure on the front-side plane comprises attaching elements for attaching the sheet to the rectangular frame structure.

3. The ball rebound device according to claim 2, wherein the attaching elements have the form of knobs, pulleys, hooks or the like.

4. The ball rebound device according to claim 1, wherein the first and second fillets adjustably abut the front-side plane of the rectangular frame structure by means of a screw principle.

5. The ball rebound device according to claim 1, wherein the sheet is a net or a net-like structure.

6. The ball rebound device according to claim 5, wherein the net or the net-like structure is connected to the attaching elements at the end meshes or edge loops of the net.

7. The ball rebound device according to claim 1, wherein an adjustable supporting structure for enabling the frame structure to stand on the ground is attached to the frame structure.

8. The ball rebound device according to claim 7, wherein wheels are arranged in connection with the adjustable support structure.

9. A method for assembling a ball rebound device according to claim 1, the method comprising the step of:

assembling a rectangular frame structure comprising two vertical frame elements and two horizontal frame elements joined together to form the rectangular frame structure, wherein forward-facing surfaces of the two vertical frame elements and two horizontal frame elements define a front-side plane of the rectangular frame structure;

abutting a first fillet on at least one of the two vertical frame elements on the forward-facing surfaces defining the front-side plane of the rectangular frame structure;

abutting a second fillet on at least one of the two horizontal frame elements on the forward-facing surfaces defining the front-side plane of the rectangular frame structure;

attaching a sheet to the first and second fillets abutting the front-side plane of the rectangular frame structure using attaching elements; and wherein the first and second fillets adjustably abut the front-side plane of the rectangular frame structure, such that the tension of the sheet is configured to be increased or decreased.

10. The method according to claim 9, wherein the method furthermore comprises the step of attaching adjustable supporting structure to the frame structure to enable the frame structure to stand on the ground.

11. The method according to claim 9, wherein the sheet comprises edge masks held in place by fixing means, preferably hook- and loop-fasteners.

* * * * *